United States Patent [19]

Ripani et al.

[11] Patent Number: 4,627,337

[45] Date of Patent: Dec. 9, 1986

[54] LEAK-RESISTANT FEEDING CHAMBER FOR CHOCOLATE REFINING MACHINES

[75] Inventors: Sergio Ripani; Giulio Serafini, both of Milan, Italy

[73] Assignee: Carle & Montanari S.p.A., Italy

[21] Appl. No.: 723,318

[22] Filed: Apr. 15, 1985

[30] Foreign Application Priority Data

May 10, 1984 [IT] Italy ..... 20861 A/84

[51] Int. Cl.[4] ..... B02C 25/00

[52] U.S. Cl. ..... 99/485; 29/110; 29/123; 99/646 R; 100/168; 100/176

[58] Field of Search ..... 99/474, 485, 516, 534, 99/452, 460, 486–489; 426/475, 486, 518, 629; 241/34–37; 100/168–171, 176, 43, 47; 425/140, 148, 363, 367, 206–209; 29/110, 126, 130, 123; 366/77

[56] References Cited

U.S. PATENT DOCUMENTS

| | | | |
|---|---|---|---|
| 2,216,777 | 10/1940 | Hollstein | 99/516 |
| 3,132,581 | 5/1964 | Isbey et al. | 100/171 |
| 3,921,514 | 11/1975 | Biondetti | 100/176 X |
| 3,990,391 | 11/1976 | Singh | 100/176 X |
| 4,519,304 | 5/1985 | Ripani | 99/489 |
| 4,538,978 | 9/1985 | Cerboni | 366/77 X |

*Primary Examiner*—Timothy F. Simone

*Attorney, Agent, or Firm*—Kirschstein, Kirschstein, Ottinger & Israel

[57] ABSTRACT

A lateral end upright for the feeding roll pair in chocolate refining machines is formed by two half-uprights in mutual abutment relationship and individually mounted to one of the feeding rolls. The abutment sides of the half-uprights have a thickness dimension which is selected to ensure continuity thereof even with the feeding roll axles tilted to their full oscillated positions. A flexible insert may be interposed to the upright halves. Offsetting play due to wear can be taken up, as can differences in the working lengths of the feeding rolls.

13 Claims, 6 Drawing Figures

LEAK-RESISTANT FEEDING CHAMBER FOR CHOCOLATE REFINING MACHINES

BACKGROUND OF THE INVENTION

This invention relates to lateral end uprights for the feeding roll pair in chocolate refining machines.

As is known, in chocolate refining machines, chocolate paste is fed into the machine by means of a pair of feeding rolls. The feeding chamber is formed by the juxtaposed upper portions of said feeding rolls, and at the sides, by lateral end uprights or legs having a substantially wedge-like configuration wherein the sloping sides are replaced by arcuate portions bearing on said juxtaposed feeding rolls. More specifically, the uprights are made to bear on the rolls and an end stepped-down portion of said rolls, so that the sealing surface area is increased while forming an abutment shoulder on the roll against which springs or pneumatic device can be urged by means of wedges to improve the upright sealing. In the radial direction, said uprights bear on the rolls by gravity. Thus, a seal is achieved both against the radial and axial pressures.

In fixed axle roll refining machines, prior lateral end uprights can only provide a proper seal with the feeding rolls held truly in parallel and having exactly the same working lengths. In the instance of some slight differences in length, in fact, the uprights would only bear axially in the abutment step of the longer roll, to leave at the shortest roll a gap whereat product leakage occurs. Such leakage paths would also be formed in the event that the axes of the feeding rolls are not truly parallel to each other.

In recent years, chocolate refining machines have been disclosed (refer to Italian Patent Application No. 21 357/83 by the same Applicant) wherein the refining rolls are mounted oscillably in a horizontal plane to achieve an equivalent effect of crown variation in the refining rolls in order to affect the plasticity or viscosity of chocolate being refined. In such refining machines, the input roll of the feeding roll pair is also mounted oscillably in the horizontal plane, thereby in operation, the axle of the input roll is allowed to set obliquely in the horizontal plane relatively to the adjacent feeding roll in the pair, and consequently, with prior lateral end uprights, the above-mentioned chocolate leaking gaps would be formed even for small inclination angles on the order of 1 or 2 degrees.

SUMMARY OF THE INVENTION

It is a primary object of this invention to provide lateral end uprights for the feeding roll pair in chocolate refining machines, which can positively prevent formation of chocolate leaking paths due to misalignment of the feeding roll axes, nd specifically, both in the instance of manufacturing misalignment in refining machines of recent construction, and of misalignment due to wear in conventional refining machines.

Moving from lateral end uprights of substantially wedge-like configuration, this object is achieved, according to the invention, by that:

the two lateral end uprights are each formed by two half-uprights in mutual abutment relationship, each of the upright halves being associated with one feeding roll;

that the abutting sides of said upright halves are adapted to permit of a relative movement of said upright halves while maintaining the continuity or seal therebetween; and the upright halves are equipped with supporting and guiding means, and preferably with an elastic preload means in the transverse direction to said rolls.

According to the invention, moreover, the relatively movable upright halves have a thickness dimension selected to allow the same to move relatively to each other while remaining in mutual metal-to-metal contact, i.e. while retaining continuity of their abutment sides.

According to another aspect of the invention, the supporting and guiding means comprise a contoured bronze ring, which engages geometrically, through a contoured segment thereof, with a correspondingly contoured segment of the associated upright half, and is secured on its respective roll by a ring which can be firmly connected to said roll in detachable manner.

Advantageously, the contoured segments of the half-upright supporting and guiding ring are set obliquely. The elastic preloading means advantageously comprises springs.

Metal-to-metal continuity or sealing may also be achieved between the upright halves of this invention by interposing elastic or flexible inserts, such as metal or synthetic or rubber foils mounted bellows-like between the abutting sides of the upright halves.

The lateral end uprights of this invention can be implemented in an extremely simple way and afford a faultless relative movement feature, while ensuring an optimum seal at any inclination angles of the feeding roll axes. Another advantage resides in their being easily and quickly assembled irrespective of the relative positions of the two feeding rolls, or of the working lengths thereof; this allows direct taking up without difficulty of any differences in the working lengths of the feeding rolls, even with fixed axle roll refining machines.

An additional advantage of the lateral end uprights herein proposed is that any wear play easily by acting in a simple and quick manner on the locking rings, or on adjustment screws thereof which act on the bronze locating ring.

BRIEF DESCRIPTION OF THE DRAWINGS

Further features, advantages, and details of tnhe lateral end uprights according to this invention will become apparent from the following description with reference to the accompanying drawings, which show schematically a preferred embodiment thereof by way of example, and where.

DESCRIPTION OF THE PREFERRED EMBODIMENT

Figure 1:
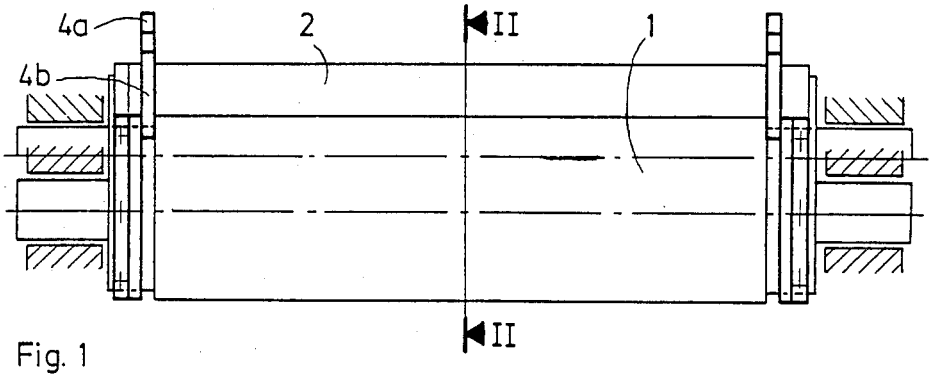
FIG. 1 is a top view of the feeding roll pair in a chocolate refining machine having a horizontally oscillator input roll.

Like parts are designated with the same reference characters throughout.

Figure 3:
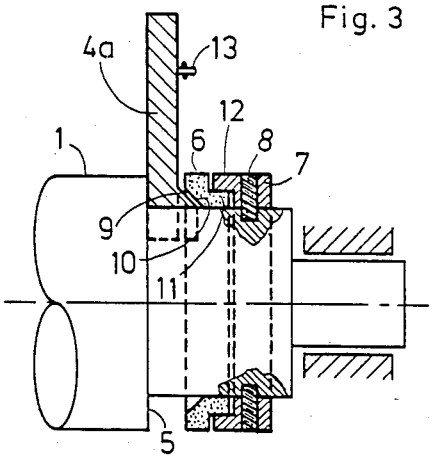
FIGS. 3 and 4 show respective sectional views of the end portion taken along the lines III—III and IV—IV of FIG. 2.
Figure 4:
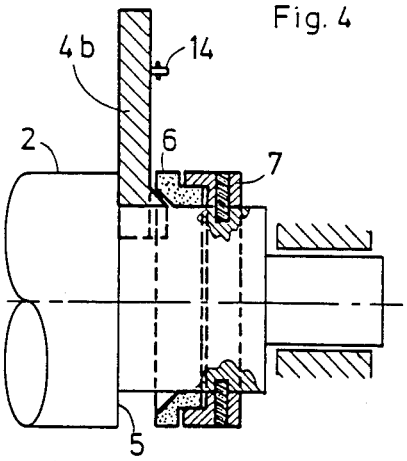

The rolls in the feeding roll pair of a chocolate refining machine, not shown, of the oscillable roll type are indicated at 1 and 2, and precisely, indicated at 1 is the input or movable roll. The numeral 3 designates the first in a series of refining rolls proper, no further shown. The two lateral end uprights or legs are indicated at 4, being each comprised of a half-upright 4*a* and half-upright 4*b*. When joined together, they show the conventional substantially wedge-like configuration. As may be seen in FIGS. 3 and 4, the feeding rolls 1 and 2 are formed with a stepped-down end portion 5 adapted to fit in the supporting lateral end uprights, in a manner known per se.

More specifically, the roll 1 carries the upright half 4*a* and the roll 2 the upright half 4*b*. Support is provided, in the example shown, by a supporting and locating ring 6 and ring 7 for locking to the roll. Locking is effected by means of radially extending screws 8, as shown. Each half-upright, 4*a*, 4*b*, is brought to a proper position by a contoured segment 9 provided thereon cooperating with a correspondingly contoured segment 10 formed on the ring 6. The latter is also formed with a recessed step 11 for engagement by a projection 12 formed on the locking ring 7. If desired, the surface 11 and side of the projection 12 cooperating with it could be contoured.

Figure 2:
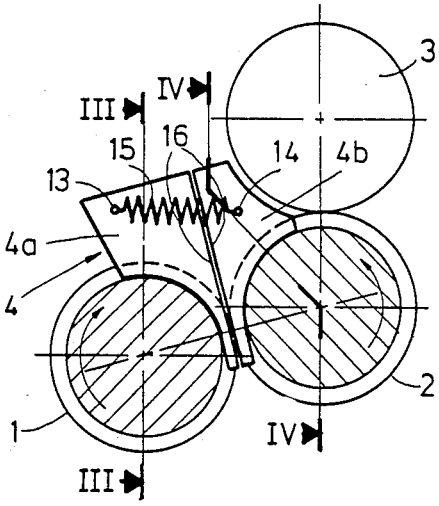
FIG. 2 is a sectional view taken along the line II—II of FIG. 1.
Figure 5:
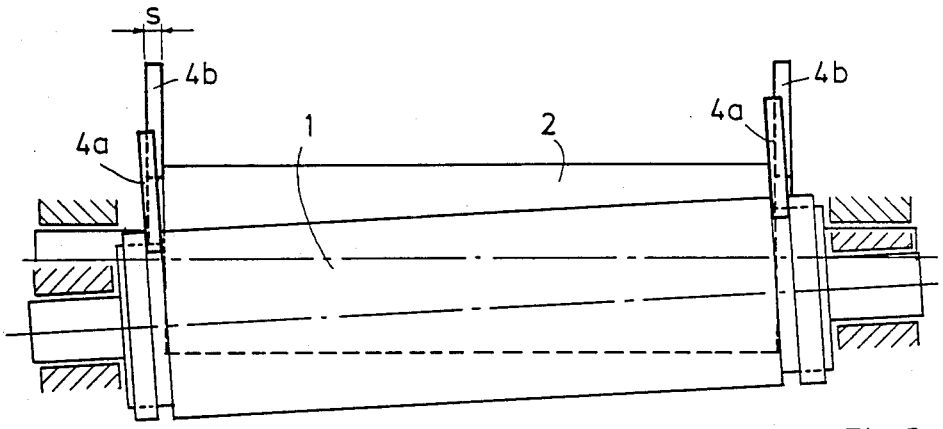
FIG. 5 is a top view similar to FIG. 1 but showing the input roll tilted in a horizontal plane.
Figure 6:
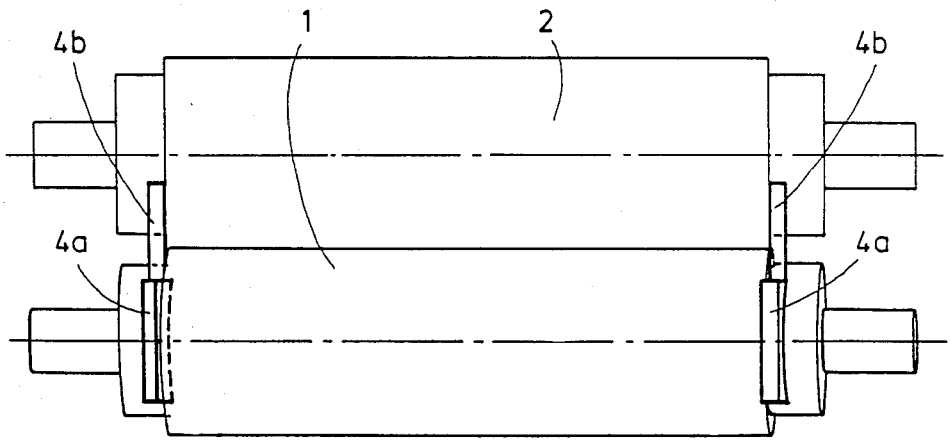
FIG. 6 is a front view taken in the direction A of FIG. 5 and slightly in perspective.

With the provision of contoured surfaces 9 and 10, faultless location of the half-uprights 4*a* and 4*b* can be achieved in the stepped-down portions 5, while providing a faultless sealing action on each end of the rolls 1,2, i.e. in each upright half. The same are split either as shown in FIG. 2 or along some different partition line. Indicated at 13 and 14 are holder pins for a tension spring 15. As may be appreciated in particular from FIG. 5, the thickness "s" of the upright halves 4*a* and 4*b* is such as to retain metal-to-metal continuity or contact, i.e. tight seal, between the abutting sides 16 of the upright halves 4*a* and 4*b*, even at the fully tilted position as shown in FIGS. 5 and 6.

It may be appreciated from the foregoing that with the lateral end uprights of this invention the object underlying the invention can be effectively achieved along with the above-mentioned advantages.

Also contemplated by the invention is that a rubber, plastics, or metal foil, e.g. steel foil, insert or "derma" may be provided between the abutting sides 16 of the upright halves 4*a* and 4*b* to provide atight seal at the ambient area of said upright halves. That insert may be assembled in any suitable way, such as by riveting along the outer edges, welding, force fitting into grooves, etc., or even be formed integrally with the upright halves.

It may be appreciated from the foregoing that this approach effectively achieves the invention object and advantages mentioned hereinabove; such an approach being equally useful with fixed axle refining machines and oscillating axle machines.

In practicing the invention, each part may be replaced with other technically and/or functionally equivalent parts without departing from the scope of this invention. As an example, any desired contours may be imparted to the abutting sides of the upright halves, and the contours of the contoured segments of the half-jaws and intermediate bronze ring may be varied as desired. The geometry of the cantilevered portion of the upright halves may be changed, and the same may be provided with the intermediate "derma" formed by a single piece of a suitable plastic material, etc.

While the above description makes reference to a chocolate refining machine, it is contemplated by this invention that the lateral end uprights may be utilized wherever they are apt to solve similar problems to those pointed out hereinabove.

All of the features described, shown, and claimed herein are regarded to be substantial to the invention, either singly or in any combinations thereof.

We claim:

1. A leak-resistant feeding chamber for feeding chocolate paste to a chocolate refining machine, comprising:

(a) a pair of feeding rolls each elongated along, and rotatable about, different longitudinal axes of rotation, (b) one of the feeding rolls having a cylindrically elongated first main portion of a predetermined diameter, a cylindrical first end portion at one end region of the first main portion, and a cylindrical second end portion at an opposite end region of the first main portion, each end portion of the one feeding roll having a diameter less than said predetermined diameter of the first main portion, (c) the other of the feeding rolls having a cylindrically elongated second main portion of a predetermined diameter, a cylindrical first end portion at one end region of the second main portion, and a cylindrical second end portion at an opposite end region of the second main portion, each end portion of the other feeding roll having a diameter less than said predetermined diameter of the second main portion, (d) said first and second main portions longitudinally engaging and juxtaposed with each other, and having conveying surfaces which convey chocolate paste to the machine during rotation of the feeding rolls, said conveying surfaces bounding a base for the feeding chamber, (e) a pair of upright first end walls respectively mounted on, and transversely spanning between, the first end portions of the feeding rolls, and together bounding one end for the feeding chamber, (f) a pair of upright second end walls respectively mounted on, and transversely spanning between, the second end portions of the feeding rolls, and together bounding an opposite end for the feeding chamber, (g) said first end walls sealingly engaging each other to resist chocolate paste from escaping from the feeding chamber at said one end thereof, and (h) said second end walls sealingly engaging each other to resist chocolate paste from escaping from the feeding chamber at said opposite end thereof.

2. The feeding chamber as recited in claim 1; and further comprising means for continuously urging the first end walls into sealing engagement with each other, and for continuously urging the second end walls into sealing engagement with each other.

3. The feeding chamber as recited in claim 2, wherein the urging means includes a pair of elongated springs, one for each pair of end walls, each spring transversely spanning between, and connected to, each pair of end walls.

4. The feeding chamber as recited in claim 1; and further comprising means for adjustably positioning along each longitudinal axis each end wall into abutting, sealing engagement with the respective end region of the respective main portion.

5. The feeding chamber as recited in claim 4, wherein the adjustable positioning means includes a locating ring mounted on, and surrounding, each end portion of the feeding rolls, and a locking ring mounted on, and surrounding, each end portion of the feeding rolls, each locking ring being mounted axially adjacent to the respective locating ring.

6. The feeding chamber as recited in claim 5, wherein each locating ring has a tapered bore facing a complementarily contoured inclined step formed on each end wall.

7. The feeding chamber as recited in claim 5, wherein each locking ring is fixed to the respective end portion by radially-extending fasteners that are turnable to lockingly engage the respective end portion.

8. The feeding chamber as recited in claim 1; and further comprising means extending between the first end walls for sealing said one end of the feeding chamber, and also extending between the second end walls for sealing said opposite end of the feeding chamber.

9. The feeding chamber as recited in claim 1, wherein the feeding rolls are mounted in a predetermined orientation relative to one another; and wherein the first end walls sealingly abut each other, and wherein the second end walls sealingly abut each other, even in the event that the feeding rolls assume an orientation different from said predetermined orientation.

10. The feeding chamber as recited in claim 9, wherein the feeding rolls are mounted with their longitudinal axes substantially parallel to each other; and wherein the first end walls mutually abut each other, and wherein the second end walls mutually abut each other, even in the event that the longitudinal exes are out of parallelism.

11. The feeding chamber as recited in claim 10, wherein the feeding rolls are fixedly mounted in a chocolate refining machine of the fixed axle type.

12. The feeding chamber as recited in claim 10, wherein the one feeding roll is fixedly mounted, and the other feeding roll is oscillably mounted for displacement in a chocolate refining machine of the oscillatable axle type.

13. The feeding chamber as recited in claim 12, wherein each pair of end walls sealingly engage each other at mutually facing contact surfaces, said contact surfaces having a thickness dimension, as condisered along the longitudinal direction, such that the contact surfaces at least partially axially overlap each other to maintain their mutual sealing engagement during displacement of the other feeding roll.

* * * * *